US006019020A

United States Patent [19]

Liou

[11] Patent Number: 6,019,020

[45] Date of Patent: Feb. 1, 2000

[54] PIPE WRENCH WITH TRANSVERSE RETAINING FUNCTION

[76] Inventor: Mou-Tang Liou, No. 57, Kung Yeh North Road, Nan Kang Industrial Park, Nantou City, Nantou Hsien, Taiwan

[21] Appl. No.: 09/151,244

[22] Filed: Sep. 14, 1998

[51] Int. Cl.[7] ..... B25B 7/04

[52] U.S. Cl. ..... 81/407; 81/411; 81/413

[58] Field of Search ..... 81/405–414, 487, 81/409.5

[56] References Cited

U.S. PATENT DOCUMENTS

| | | | |
|---|---|---|---|
| 2,622,464 | 12/1952 | Daugherty | 81/414 |
| 4,232,573 | 11/1980 | Dace, Jr. | 81/414 |
| 4,719,827 | 1/1988 | Igarashi | 81/414 |
| 4,890,519 | 1/1990 | Le Duc | 81/414 |
| 4,901,609 | 2/1990 | Crum | 81/405 |
| 5,904,078 | 5/1999 | Gustafson et al. | 81/405 |

*Primary Examiner*—James G. Smith
*Assistant Examiner*—Lee Wilson
*Attorney, Agent, or Firm*—Charles E Baxley, Esq.

[57] ABSTRACT

A pipe wrench includes a first elongated member and a second elongated member. A first intermediate section of the first elongated member includes a recess defined in an inner side thereof that faces a second intermediate section of the second elongated member. A bottom wall that defines the recess has a ridge formed thereon. A first stepped portion and a second stepped portion are formed on two sides of the recess, respectively. A first pin and a second pin are respectively formed on the first stepped portion and the second stepped portion. The second intermediate section includes a number of parallel channels defined in an inner side thereof that faces the first intermediate section. The ridge is releasably engaged with one of the channels. A panel is mounted to an outer side of second intermediate section and includes two holes through which the first pin and the second pin are extended and riveted, respectively. The panel is securely engaged with the first intermediate section of the first elongated member to enclose the second intermediate section of the second elongated member. The panel includes two resilient blocks that exert a force to bias the second intermediate section toward the first intermediate section such that the first intermediate section and the second intermediate section closely contact with each other to thereby provide a reliable grasping effect.

1 Claim, 6 Drawing Sheets

PIPE WRENCH WITH TRANSVERSE RETAINING FUNCTION

BACKGROUND OF THE INVENTION

1. Field of the Invention

The present invention relates to a pipe wrench that can be securely retained in a transverse direction to provide reliable engaging effect for two elongated members of the pipe wrench.

2. Description of the Related Art

Pipe wrenches are usually used in daily life. Examples of pipe wrenches are shown in, e.g., U.K. Patent No. 15,057 to Barnes, Swedish Patent No. 62168, etc. These patents allow the two jaws of the wrench to be adjusted in the distance therebetween to fittingly grasp an object. Nevertheless, the two elongated members of the wrench cannot have secure engagement in the transverse direction, which may adversely affect the grasping effect. U.S. Pat. No. 4,232,573 to Dace, Jr. discloses a set of slip-type pliers that also allows adjustment in the distance between the two jaws. Although a nut 30 is used to secure one elongated member with a slot defined therein to the other elongated member with guide channels defined therein, the engagement of the two elongated members in the transverse direction is still not reliable and thus adversely affects the grasping effect. In addition, the structural strength of the slotted elongated member is weakened due to provision of the slot. The present invention is intended to provide an improved design for pipe wrenches to solve these problems.

SUMMARY OF THE INVENTION

It is a primary object of the present invention to provide an improved pipe wrench in which the two elongated members are reliably engaged in the transverse direction to provide a reliable grasping effect between the jaws.

A pipe wrench in accordance with the present invention comprises a first elongated member and a second elongated member. The first elongated member includes a first jaw end, a first handle end, and a first intermediate section interconnected between the first jaw end and the first handle end. The second elongated member includes a second jaw end, a second handle end, and a second intermediate section interconnected between the second jaw end and the second handle end.

The first intermediate section includes a recess defined in an inner side thereof that faces the second intermediate section A bottom wall that defines the recess has a ridge formed thereon. A first stepped portion and a second stepped portion are formed on two sides of the recess, respectively. A first pin and a second pin are respectively formed on the first stepped portion and the second stepped portion.

The second intermediate section includes a plurality of parallel channels defined in an inner side thereof that faces the first intermediate section. The ridge is releasably engaged with one of the channels. The second intermediate section further includes an outer side opposite to the inner side thereof.

A panel is mounted to the outer side of second intermediate section and includes two holes through which the first pin and the second pin are extended and riveted, respectively. The panel is securely engaged with the first intermediate section of the first elongated member to enclose the second intermediate section of the second elongated member. The panel includes two resilient blocks that exert a force to bias the second intermediate section toward the first intermediate section such that the first intermediate section and the second intermediate section closely contact with each other to thereby provide a reliable grasping effect.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
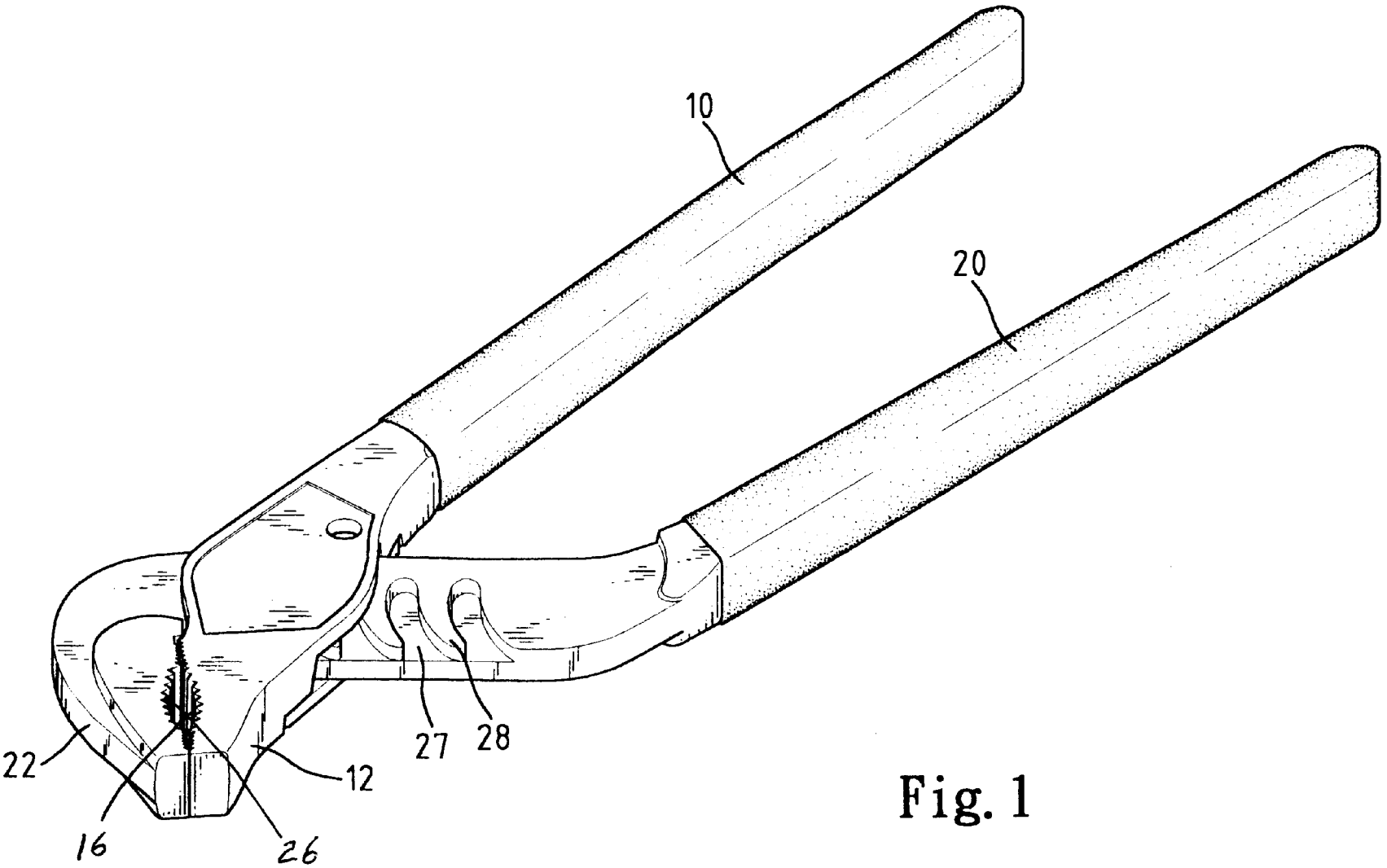
FIG. 1 is a perspective view of a pipe wrench in accordance with the present invention.
Figure 2:
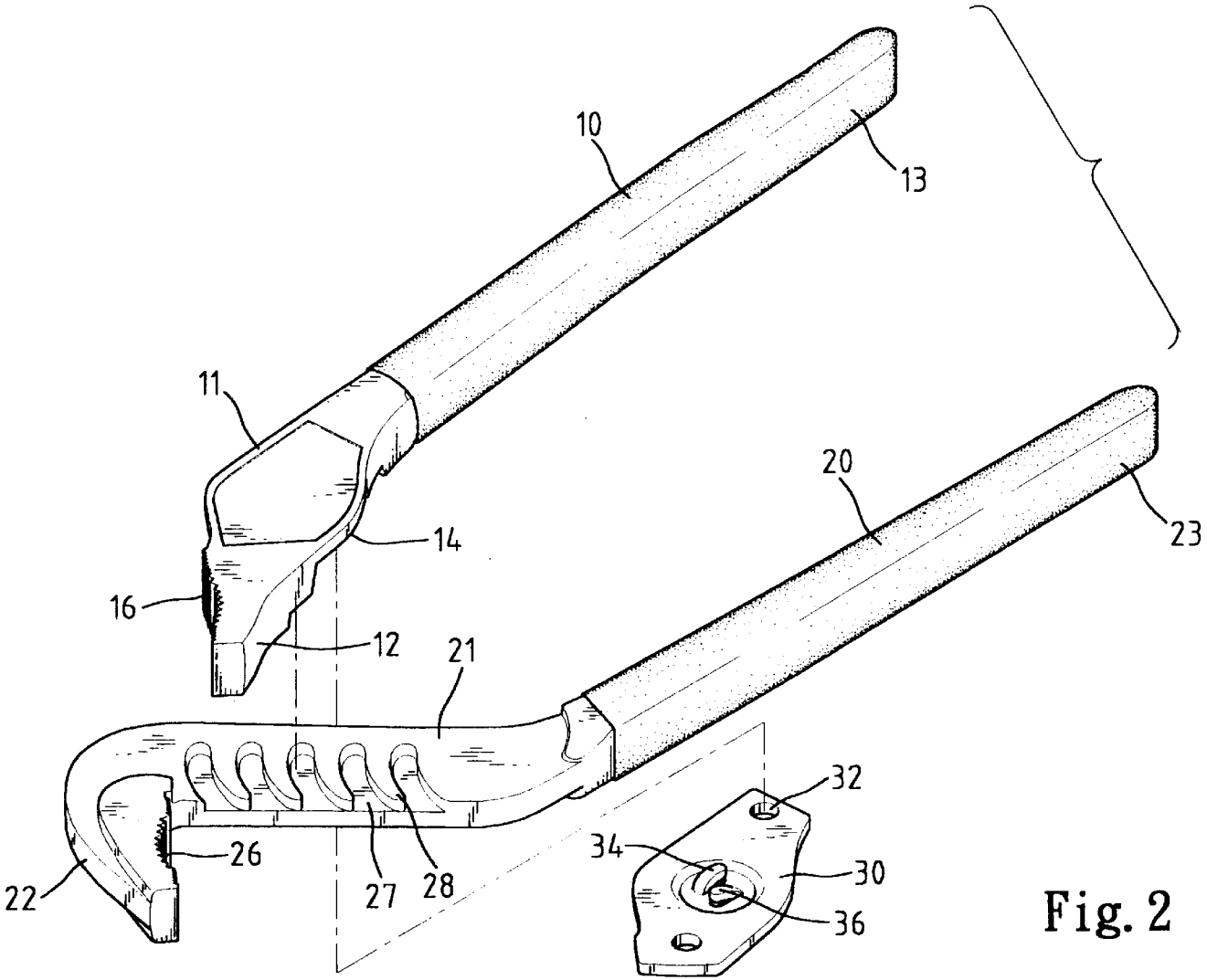
FIG. 2 is an exploded perspective view of the pipe wrench.

Referring to the drawings and initially to FIGS. 1 and 2, a pipe wrench in accordance with the present invention generally includes a first elongated member 10 and a second elongated member 20. The first elongated member 10 has a first jaw end 12, a first handle end 13, and a first intermediate section 11 interconnected between the first jaw end 12 and the first handle end 13. The second elongated member 20 has a second jaw end 22, a second handle end 23, and a second intermediate section 21 interconnected between the second jaw end 22 and the second handle end 23. Each jaw end 12, 22 includes a number of teeth defined in an 12 inner side thereof for grasping purpose.

Figure 3:
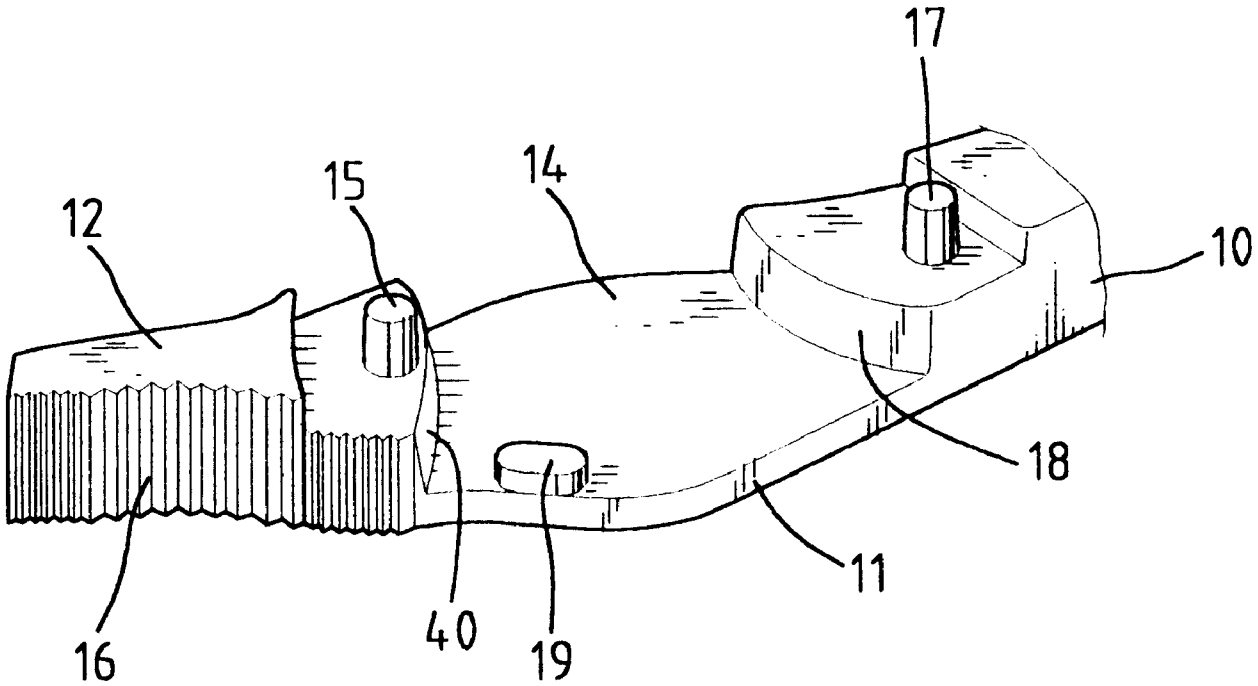
FIG. 3 is a perspective view illustrating an underside of a front portion of an elongated member of the pipe wrench.

As shown in FIG. 3, the first intermediate section 11 includes a recess 14 defined in an inner side thereof that faces the second intermediate section 21. A ridge 19 is formed on a bottom wall that defines the recess 14. In addition, a first pin 15 and a second pin 17 are respectively formed on two sides of the recess 14. In this embodiment, the first pin 15 is mounted on a first stepped portion 40 located at a first side of the recess 14, while the second pin 17 is formed on a second stepped portion 18 located at a second side of the recess 14.

Figure 4:
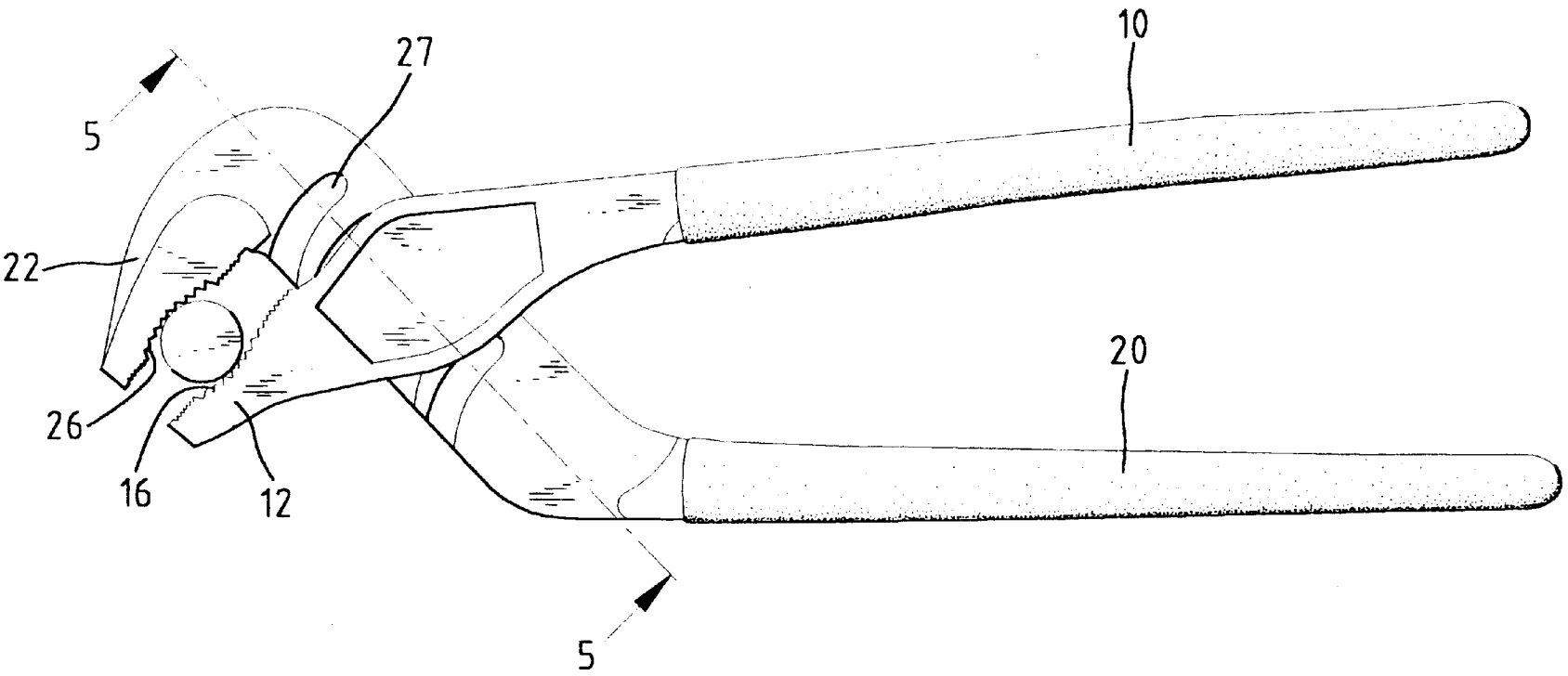
FIG. 4 is a top view of the pipe wrench in use.
Figure 5:
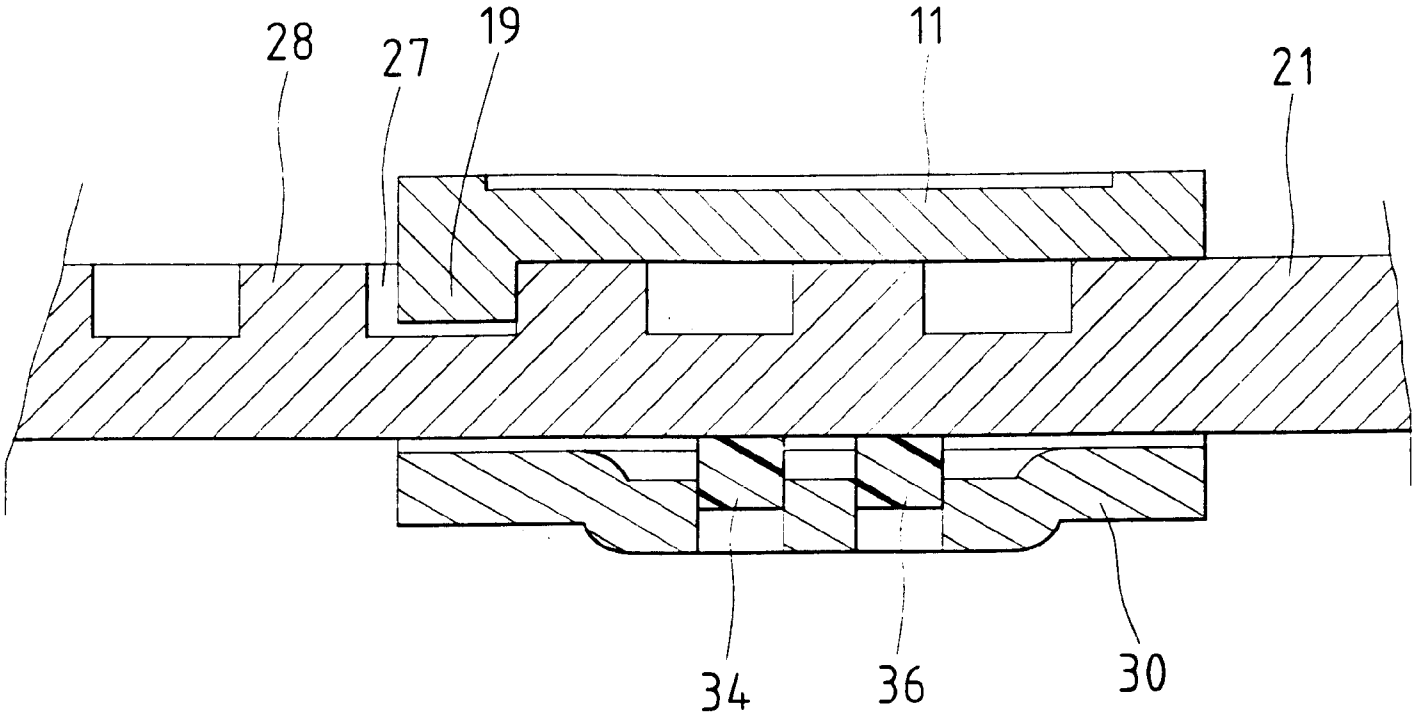
FIG. 5 is a partial sectional view taken along line 5—5 in FIG. 4.

The second intermediate section 21 includes a number of parallel channels 27 defined in an inner side thereof that faces the first intermediate section 11 and spaced by separation walls 28. The ridge 19 is selected to engage with one of the channels 27, which will be described later. A panel 30 is mounted to an outer side of second intermediate section 21 that is opposite to the inner side of the second intermediate section 21. The panel 30 includes two holes 32 through which the first pin 15 and the second pin 17 extend, respectively. The panel 30 is securely engaged with the first intermediate section 11 of the first elongated member 10 and includes two resilient blocks 34 and 36 (FIG. 5) that may exert an upward force to bias the second intermediate section 21 of the second elongated member 20 toward the first intermediate section 11 of the first elongated member 10 such that the two sections 11 and 21 closely contact with each other so as to provide a reliable grasping effect (FIG. 4). It is well known that if the two members 10 and 20 do not contact closely with each other, i.e., a space exists between the two members 10 and 20 in the transverse direction (vertical direction in FIG. 5), the grasping effect is adversely affected. Provision of the resilient blocks 34 and 36 eliminates this problem.

Figure 6:
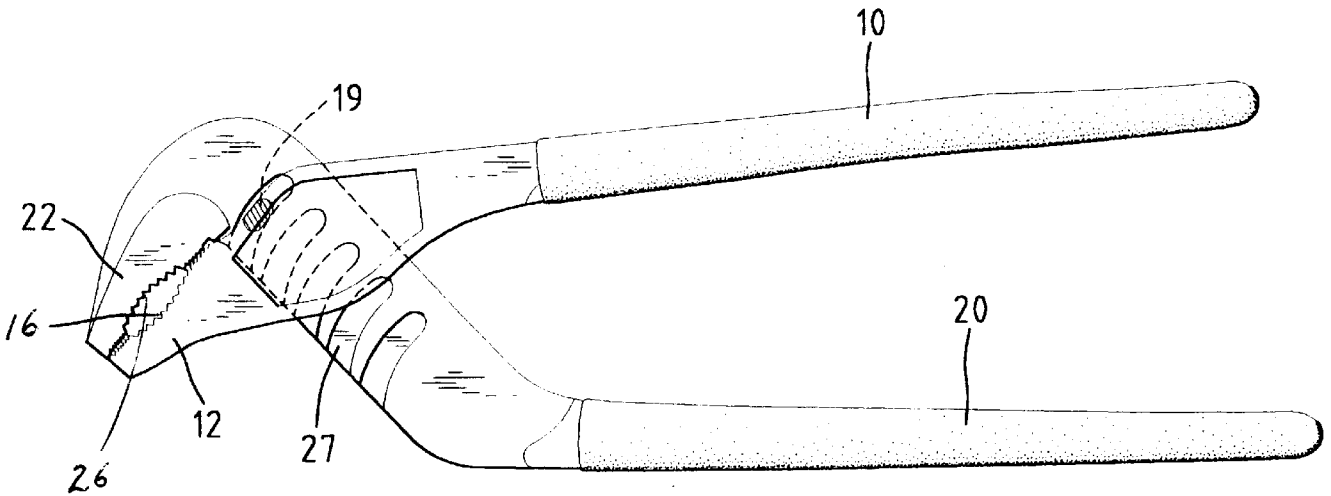
FIGS. 6 and 7 are top views illustrating adjustment in the distance between the two jaws.
Figure 7:
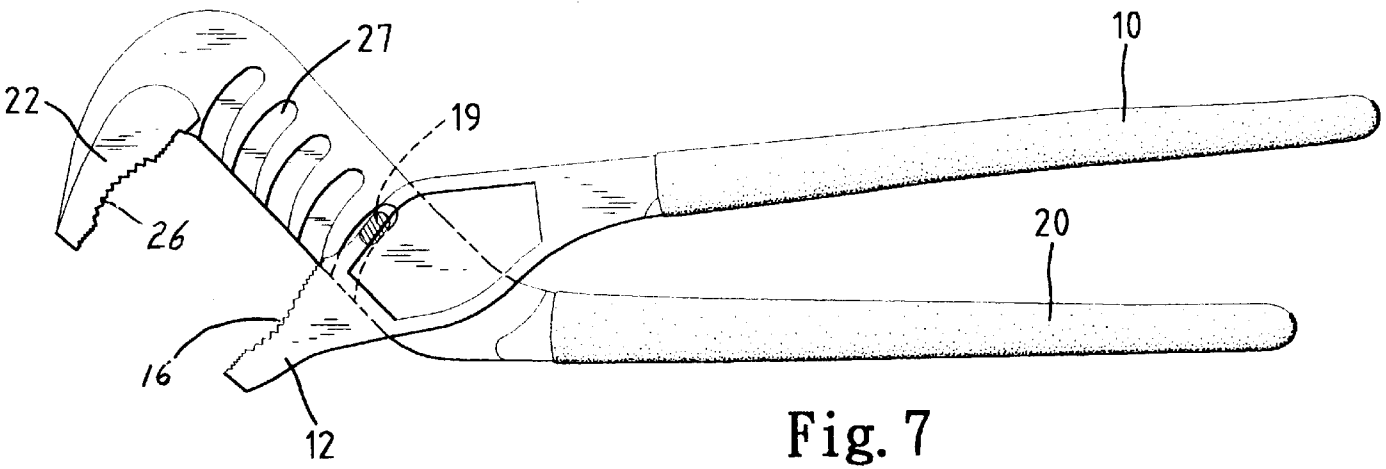

It is appreciated that the pins 15 and 17, after having been extended through the holes 32 of the panel 30, are riveted to secure the panel 30 in position and to prevent from disengagement between the first elongated member 10 and the second elongated member 20. As shown in FIGS. 6 and 7, the ridge 19 of the first elongated member 10 can be adjusted to be received in any one of the channels 27 in the second elongated member 20 so as to grasp objects of different sizes. The user may move the ridge 19 out of the channels 27 by turning the first elongated member 10 relative to the second elongated member 20, slide the ridge 19 along a lateral side of the second intermediate section 21 until the ridge 19 reaches the desired channel 27, and move the ridge 19 into the desired channel 19 by tuning the first elongated member 20 in an opposite direction. The recess 14 of the first intermediate section 11 is large enough for pivotal movements between the first elongated member 10 and the second elongated member 20 for grasping purpose.

According to the above description, it is appreciated that the resilient blocks 34 and 36 provide a close contact for the first and second elongated members 10 and 20 in the transverse direction to provide a reliable grasping effect. It is noted that the structural strength of the first elongated member 10 is not weakened, as no slot is required.

It is further appreciated that the stepped portions 18 and 40 allow easy engagement with the panel 30 to together enclose the second intermediate section 21 of the second elongated member 20. In a conventional design without provision of the stepped portions 18 and 40, the two members 10 and 20 are often engaged either too tightly or too loosely and thus adversely affect the operation of the pipe wrench. Yet this problem is avoided by provision of the stepped portions 18 and 40.

Although the invention has been explained in relation to its preferred embodiment, it is to be understood that many other possible modifications and variations can be made without departing from the spirit and scope of the invention as hereinafter claimed.

What is claimed is:

1. A pipe wrench, comprising:

a first elongated member including has a first jaw end, a first handle end, and a first intermediate section interconnected between the first jaw end and the first handle end, a second elongated member including a second jaw end, a second handle end, and a second intermediate section interconnected between the second jaw end and the second handle end, the first intermediate section including a recess defined in an inner side thereof that faces the second intermediate section, a bottom wall that defines the recess having a ridge formed thereon, a first stepped portion and a second stepped portion being formed on two sides of the recess, respectively, a first pin and a second pin being respectively formed on the first stepped portion and the second stepped portion, the second intermediate section including a plurality of parallel channels defined in an inner side thereof that faces the first intermediate section, the ridge being releasably engaged with one of the channels, the second intermediate section further including an outer side opposite to the inner side thereof, and a panel mounted to the outer side of second intermediate section and including two holes through which the first pin and the second pin are extended and riveted, respectively, the panel being securely engaged with the first intermediate section of the first elongated member to enclose the second intermediate section of the second elongated member, the panel including two resilient blocks that exert a force to bias the second intermediate section toward the first intermediate section such that the first intermediate section and the second intermediate section closely contact with each other to thereby provide a reliable grasping effect.

* * * * *